US006989093B1

(12) United States Patent
Greathead

(10) Patent No.: US 6,989,093 B1
(45) Date of Patent: Jan. 24, 2006

(54) POOL SKIMMER

(76) Inventor: James Greathead, 2095 Orange Picker Rd., Jacksonville, FL (US) 32223

( * ) Notice: Subject to any disclaimer, the term of this patent is extended or adjusted under 35 U.S.C. 154(b) by 0 days.

(21) Appl. No.: 10/760,153

(22) Filed: Jan. 16, 2004

(51) Int. Cl.
*E04H 4/16* (2006.01)

(52) U.S. Cl. ..... 210/169; 210/232; 4/496

(58) Field of Classification Search ..... 210/169, 210/232, 490, 496; 4/490, 496
See application file for complete search history.

(56) References Cited

U.S. PATENT DOCUMENTS

| | | | | |
|---|---|---|---|---|
| 4,068,327 | A | 1/1978 | Heinlein | |
| 4,781,827 | A * | 11/1988 | Shields | 210/169 |
| 5,137,623 | A | 8/1992 | Wall | |
| 5,139,660 | A * | 8/1992 | Lourie et al. | 210/169 |
| 5,173,181 | A | 12/1992 | McFarland | |
| 5,288,414 | A | 2/1994 | Mongiello | |
| 5,423,093 | A * | 6/1995 | Hall-Vandis | 4/504 |
| 5,951,858 | A * | 9/1999 | Soto et al. | 210/169 |
| 6,223,358 | B1 * | 5/2001 | DePietro | 4/498 |
| 6,270,683 | B1 * | 8/2001 | Turner | 210/776 |
| 2005/0011819 | A1 * | 1/2005 | Gillen et al. | 210/121 |

FOREIGN PATENT DOCUMENTS

| | | | |
|---|---|---|---|
| WO | WO 98/11314 | * | 3/1998 |

* cited by examiner

*Primary Examiner*—Fred G. Prince
(74) *Attorney, Agent, or Firm*—Lawrence J. Gibney, Jr.

(57) ABSTRACT

This device will be available to the pool owner to clean the surface debris from a pool on a twenty-four hour seven day a week basis. It is free standing and can be moved from location to location around the perimeter of the pool depending on the pool. The ability to move it from location to location allows maximum efficiency to clean a pool. The device allows the net to be adjusted in a vertical direction to accommodate the varying level of water in the pool.

8 Claims, 4 Drawing Sheets

POOL SKIMMER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This device relates to the cleaning of the top surface of an in-ground or above ground pool on a continuous basis. The device uses a portable base to secure a pool net in one position in a pool.

B. Prior Art

Examples of the prior art in this area consist of devices, which are either secured to the side or lip of a pool by a clasp or bracket or are permanently attached to the deck or concrete of a pool perimeter. The Mongiello, U.S. Pat. No. 5,288,414 and McFarland, U.S. Pat. No. 5,173,181 are examples of these types of devices. While the above referenced patents have the ability to clean the top surface of the pool they are otherwise fixed in place and are not readily portable.

In certain pools a particular area of the pool may be harder to clean due to an excessive amount of trees or other foliage. The current device seeks to combine the advantages of continuous skimming or cleaning and portability. The portability aspect of this device would be greatly appreciated by the pool owner as he or she seeks to maximize the cleaning of any trouble spot in the pool.

Additionally this device allows a height adjustment of the pool net, for maximum cleaning or skimming efficiency.

BRIEF SUMMARY OF THE INVENTION

One of the difficulties in maintaining a pool is to make sure that any fallen debris including leaves, twigs, and moss is trapped as soon as possible. Otherwise, this material will float to the bottom and create maintenance headaches for the homeowner as it decomposes.

The traditional method of skimming a pool is to pick up the floating debris by using a pole with a net or some other skimming device. This must be done by an individual and therefore is limited in the hours of operation.

The current invention involves a device, which is free standing and can be used at any time of day or night and is independent of any operator or individual. Because it is a freestanding device, which can be moved to any part of the pool depending on a particular need, the pool owner can position the device wherever the greatest need arises to clean the top surface of the pool.

This device is comprised of a freestanding base comprised of four legs connected by tubing or piping with an opening at one end to insert and secure a standard pool net. The net can be inserted partially below the surface of the water to catch any fallen debris, which floats on the pool surface and is directed into the net.

As the water is circulated around the pool by the pool jets, the debris on the surface floats into the net. The next day the homeowner can then simply empty the net and reposition the device, if desired.

This device is not permanently attached to the deck or concrete pool surface and can be easily moved from location to location around the perimeter of the pool surface. Because it does not depend on the efforts of an operator this device can be used around the clock, every day of the year.

It can be used on both inground and aboveground pools.

The object of the present invention is to make the cleaning of the top surface of any type of pool effortless and continuous while maintaining maximum efficiency of the existing pool filters.

DETAILED DESCRIPTION OF THE EMBODIMENTS

It is the object of this invention to trap and collect debris on the top surface of a pool on a continuous basis without the necessity of an individual operating a net or other skimming device. It is designed to be portable and lightweight to enable the pool owner to position this device where the greatest need is present.

The principal advantages of continuous skimming of the debris from the top surface of the pool include the reduced maintenance that may become necessary as a result of the failure to clean the surface and to insure that the skimmers, which are built into the side of the in ground pool work at maximum efficiency. If the skimmers become clogged the pool filter will operate at reduced efficiency. This will lead to maintenance problems for the pool owner. It is the further object of this invention to assist the skimmers operate at maximum efficiency by reducing the amount of floating debris.

Figure 1:
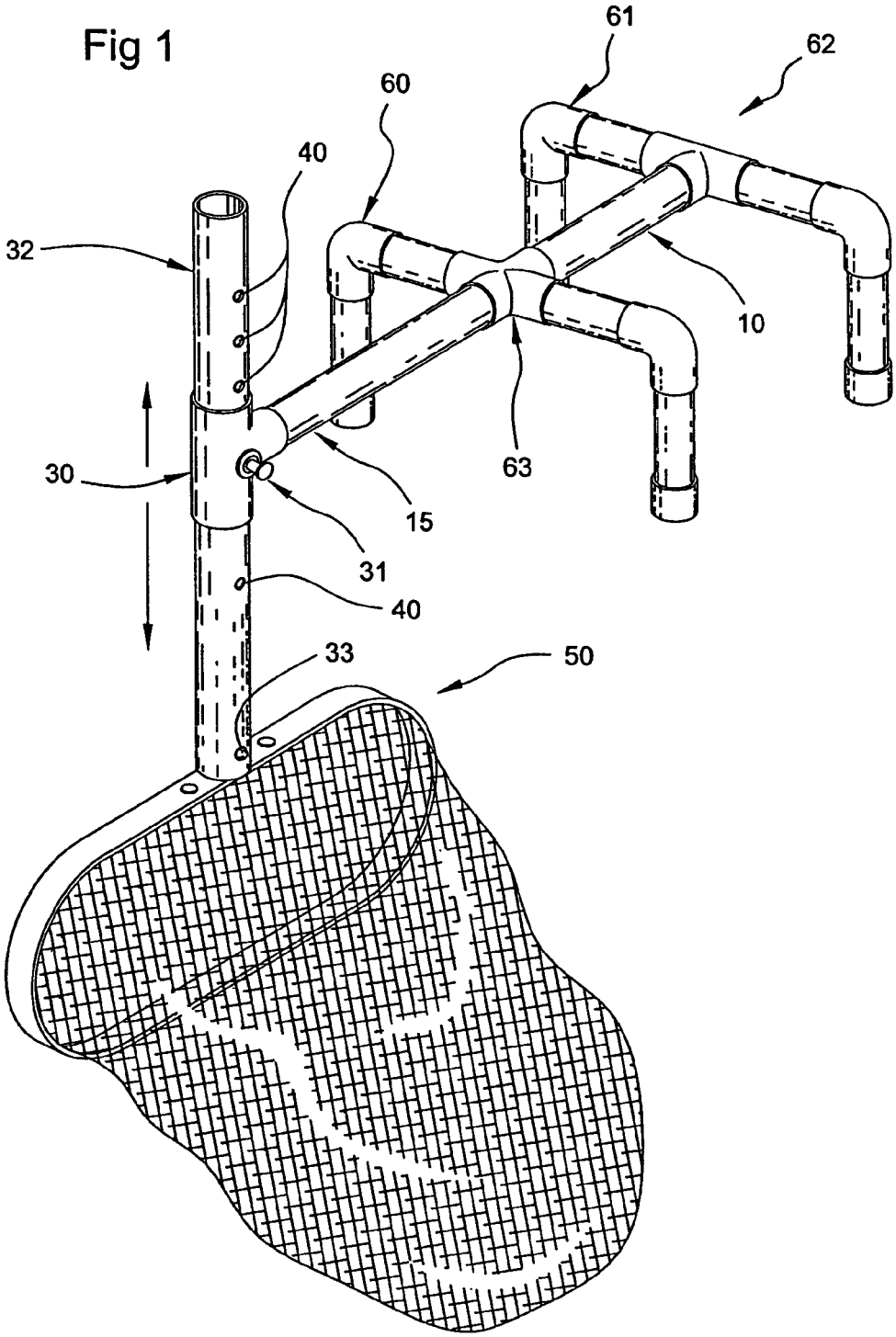
FIG. 1 is a perspective view of the device.

According to FIG. 1 this device consists of two sets of legs, which are located at the first end of the device. The legs are identical in shape and size and two sets of legs, a first or front set (60) and a second or rear set is contemplated (61). The vertical and horizontal dimensions of the pairs of legs are identical. A "T" fitting (62) connects the rear set of legs together in the approximate center. A length of tubing (10) connects the two sets of legs and is affixed to the "T" at the rear set of legs and a cross fitting (63). This tubing (10) extends from the center of the rear set of legs (61) between a "T" fitting (62) connecting the rear legs (61) and a "cross" fitting (63), which connects the rear set of legs to the front set of legs (60). Connected to the cross member fitting (63) on the front or first set of legs (60) is another length of tubing (15) which connects the front set of legs to a "T" fitting (30), which is positioned vertically, into which the height adjustment tube (32) will be inserted. The material, which will be used for construction of this device, must be water resistant and non-corrosive due to its proximity to water. It is contemplated that polyvinyl chloride (PVC) piping or other type of hard plastic will be used.

A vertical "T" fitting (30) at the second end of this device is affixed so that the net can be mounted on the first end of the height adjustment tube. The height adjustment tube (32) fits through the center of vertical "T" fitting (30).

It is anticipated that the device when assembled will have a vertical dimension of five inches off the ground. The connection points for the legs will extend radially from the centerline of the device approximately five inches. The distance between the two sets of legs will be approximately eleven inches and the distance between the second end and the cross fitting is approximately eleven inches for a total length of approximately two feet from end to end.

Two holes are drilled in the approximate center of the vertical "T" fitting (30); these holes are positioned 180 degrees apart or diametrically opposed to each other. The purpose of the holes in the vertical "T" is to secure the pool skimmer or net (50) to the device.

Another set of holes, which is placed in the height adjustment tube (32) allows the pool skimmer or net (50) to be adjusted in a vertical fashion. These vertical series of holes (40) are 180 degrees apart or diametrically opposed to each other and are drilled through the height adjustment tube (32). The holes in the height adjustment tube are approximately one inch apart and there are approximately five or six sets of holes (40) for the vertical adjustment of the pool skimmer. The diameter of the pool skimmer or net tubing is slightly less that the diameter of the height adjustment tube (32).

In addition, two holes (33), 180 degrees apart or diametrically opposed to each other, are drilled through the height adjustment tube (32) three-quarters of an inch from the bottom and attach the net (50) to the height adjustment tube (32) at the bottom of the tube proximate to the water surface. These holes (33) will receive a plastic spring loaded locking device that comes as part of the pool skimmer or net (50) to attach the pool skimmer or net to the height adjustment tube (32).

A pin (31) or other securing device is inserted through the holes in the vertical "T" or vertical connection member (30) and through the holes in the height adjustment tube (32). The type of securing device may include a cotter pin or bolt and extends through both holes to secure the pin (31) in place.

Figure 2:
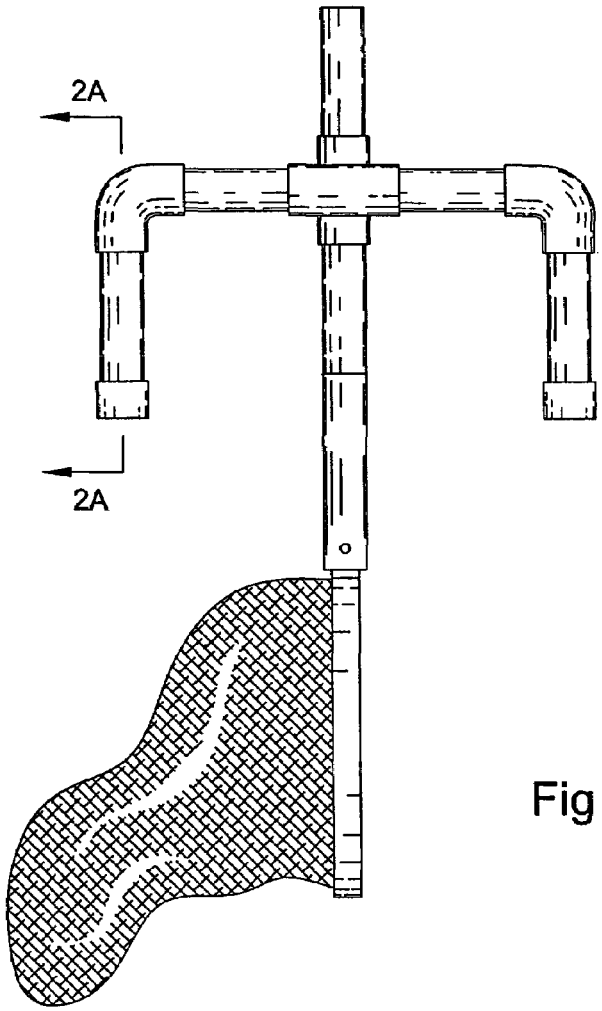
FIG. 2 is a view from the back of the device.
Figure 3:
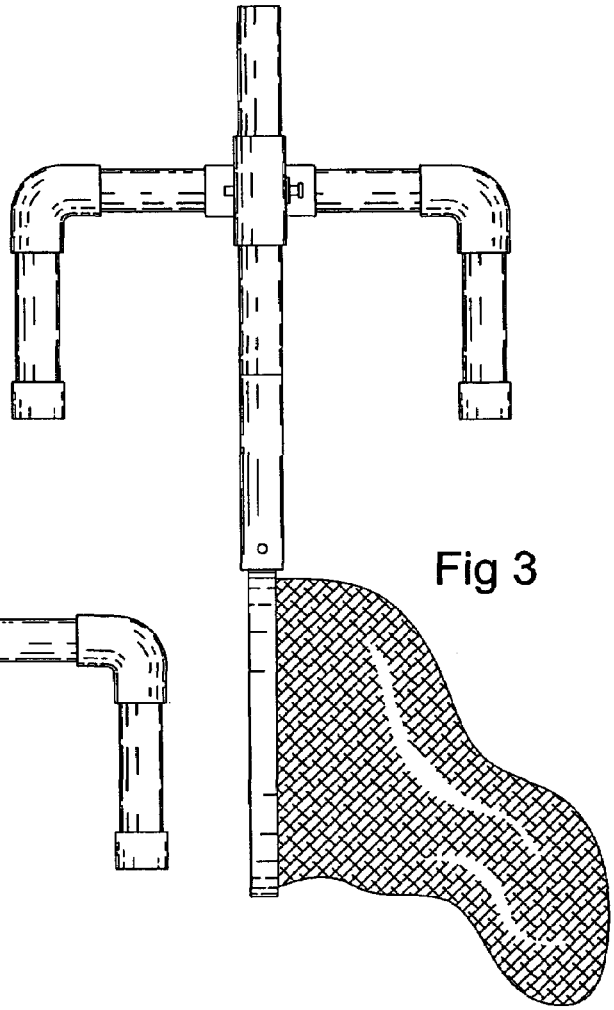
FIG. 3 is a view from the front of he device.
Figure 2A:
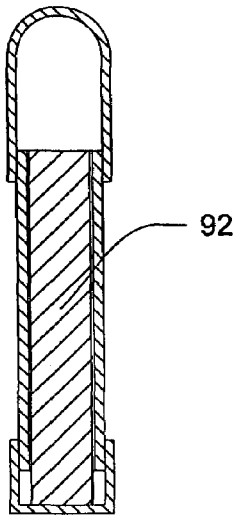
FIG. 2*a* is a cross sectional view according to line 2A—2A on FIG. 2.
Figure 4:
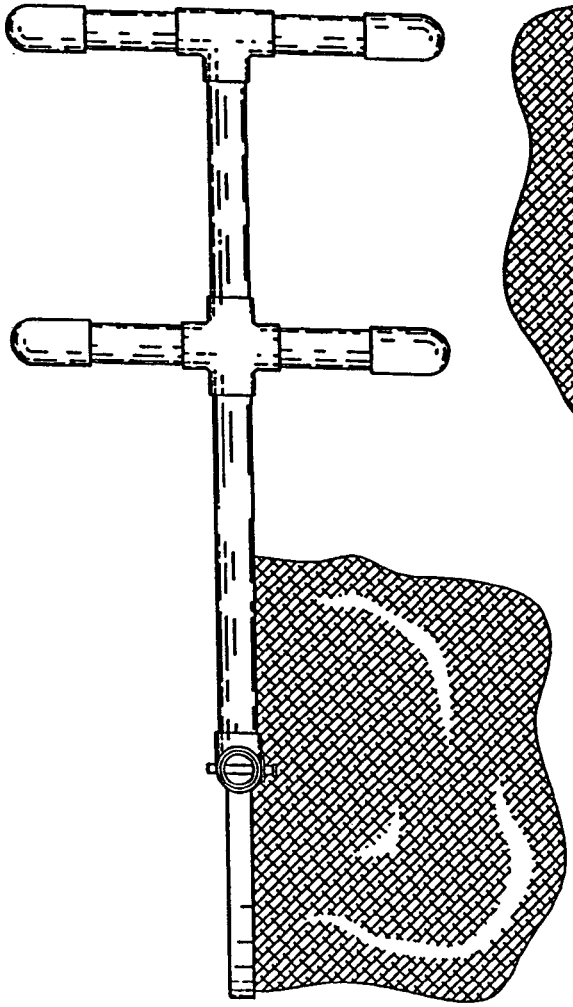
FIG. 4 is a top view of the device.
Figure 5:
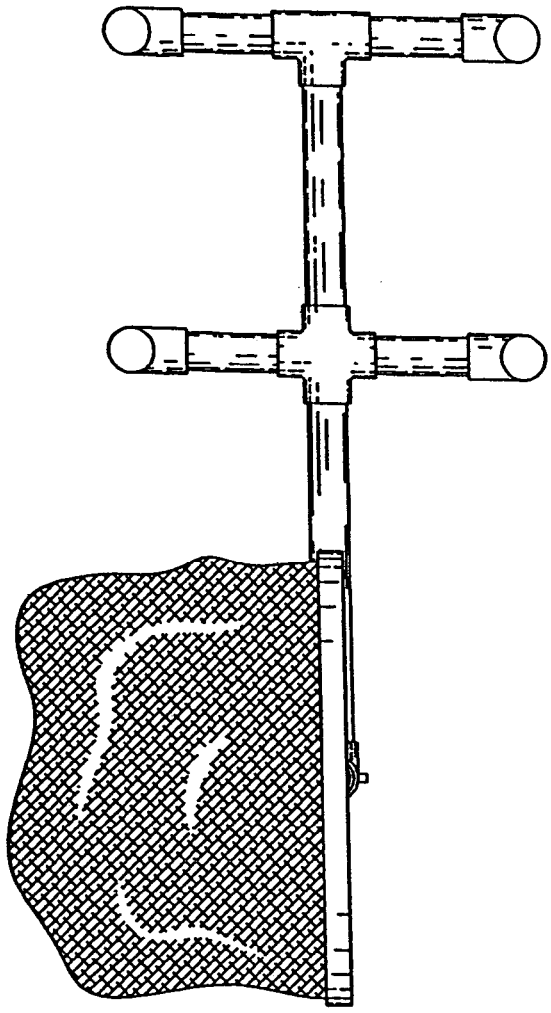
FIG. 5 is a bottom view of the device.
Figure 7:
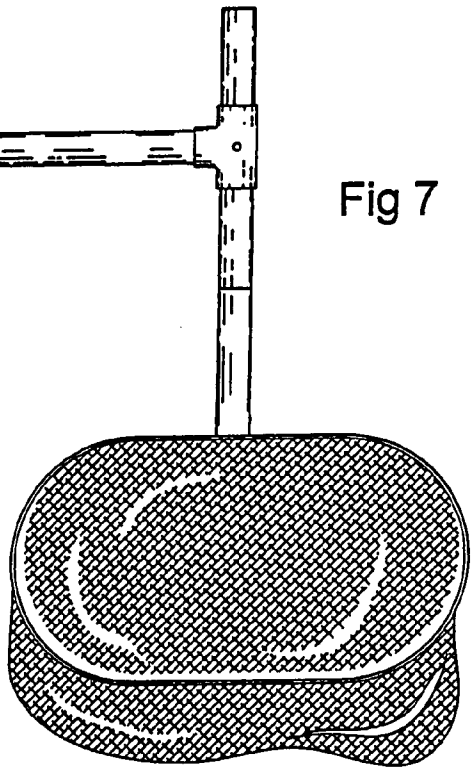
FIG. 7 is a right side view of the device.
Figure 6:
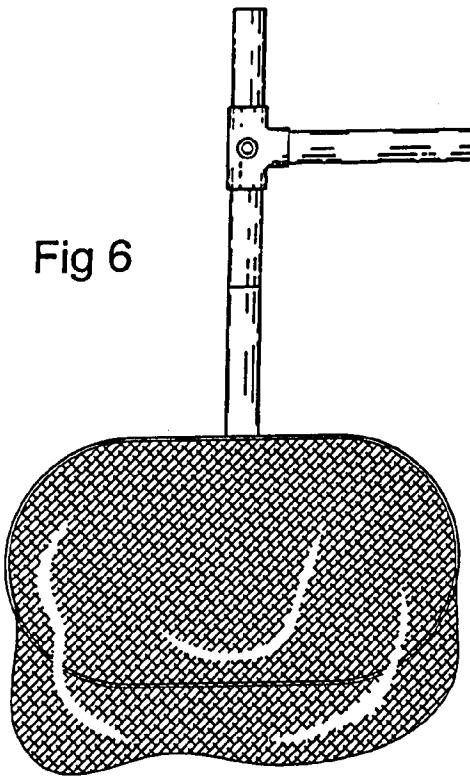
FIG. 6 is a left side view of the device.

According to FIG. 2, the adjusting tube (32) can be moved up or down to compensate for variations in the water level in the pool. The pool skimmer (50) is a standard pool net which can be purchased at any pool supply store.

The construction of the device is comprised of hollow tubing or piping, which should be lightweight and non ferrous. Within the hollow legs at the rear of the base, weight 92 is added for anti-tipping stability. Ideally, the weight 92 is added in the rear legs (61) which are further from the pool.

The device can be moved from location to location around the perimeter of the pool to collect debris form the top surface of the pool at will and with ease.

The additional Figures, which have been included in this application show the invention from the various angles for a more complete representation of the device.

What is claimed is:

1. A pool skimming device which is comprised of the following:

a. first set of legs;
b. second set of legs;
c. connective tubing;
d. cross fitting;
e. vertical connection member;
f. height adjustment tube;
g. securing device;
h. pool skimming net;

wherein said first set of legs and second set of legs are connected together by tubing to form the base of the device;
wherein said base is connected to the height adjustment tube with a piece of tubing which extends from the cross fitting to the vertical connection member;

wherein said securing device attaches to the height adjustment tube to the vertical connection member through a hole in the middle of the vertical connection member;

wherein said pool skimming net is attached to the end of the height adjustment tube approximate to the water surface;
wherein the second set of legs are constructed of hollow tubing;
wherein weight has been added to the second set of legs.

2. The connecting tubing as described in claim 1, wherein the tubing is nonferrous.

3. The vertical connection member as described in claim 1, wherein a cotter pin is inserted through a hole in the height adjustment tube to allow a height adjustment of a pool net.

4. The height adjustment tube as described in claim 1, wherein a series of holes allows the net to be adjusted in a vertical fashion relative to the surface of the pool.

5. The securing device as described in claim 1 wherein it is a cotterless hitch pin.

6. The securing device as described in claim 1 wherein it is a nut and bolt.

7. The securing device as described in claim 1 where it is a twist lock.

8. The device as described in claim 1 wherein the material used in the construction is nonferrous.

* * * * *